United States Patent [19]

Wróbel et al.

[11] 4,392,549

[45] Jul. 12, 1983

[54] BOILER NOISE SUPPRESSOR

[75] Inventors: Stanistaw Wróbel; Ryszard Węgrzyn, both of Gliwice, Poland

[73] Assignee: Instytut Chemii Nieorganicznej, Gliwice, Poland

[21] Appl. No.: 354,446

[22] Filed: Mar. 3, 1982

[30] Foreign Application Priority Data

Mar. 10, 1981 [PL] Poland ..... 230087

[51] Int. Cl.[3] ..... F01N 7/00

[52] U.S. Cl. ..... 181/239; 181/251; 181/252; 181/268; 181/272

[58] Field of Search ..... 181/212, 239, 222, 251, 181/258, 268, 275, 252, 256

[56] References Cited

U.S. PATENT DOCUMENTS 2,075,316 3/1937 Tyden ..... 181/251
4,113,048 9/1978 Teodorescu ..... 181/222 X

FOREIGN PATENT DOCUMENTS 67523 7/1973 Poland .
706551 12/1979 U.S.S.R. ..... 181/239

OTHER PUBLICATIONS

"Noise Control in Communication and Industry" by P. Roginski et al., Warszawa, 1965, p. 342, lines 16–33.
"Aviation Noise and Methods of Its Control" by T. Rajpert, Warszawa, 1980, p. 291, lines 2–9, FIG. 5–25.

*Primary Examiner*—Benjamin R. Fuller
*Attorney, Agent, or Firm*—Michael N. Meller; Anthony H. Handal

[57] ABSTRACT

A boiler noise suppressor has one truss (2) mounted on a cover of an inlet flange (1), a perforated expansion nozzle (5), a pipe system (7) made of a several hundreds of pipes, a perforated outlet nozzle (8), at least one truss (11) mounted on a collar of the outlet nozzle. The pipe system (7) can be additionally cooled in a parallel-current- or a counter-current manner preferably by air or water. The boiler noise suppressor can be connected directly to the exhaust of blow-out steam of a single boiler or in a parallel connection to form batteries of suppressors by a connection with exhausts of blow-out steam from several boilers. The application of the noise suppressor renders it possible to reduce the noise level by more than 50% from 140–160 dB to 70–80 dB.

5 Claims, 4 Drawing Figures

BOILER NOISE SUPPRESSOR

The subject of the invention is a noise suppressor of expanding gases, and especially of exhaust steam from high-pressure industrial-power boilers.

During starting high-pressure boilers from the cold state the produced wet steam is carried away to the exhaust until nominal working parameters of the boiler are obtained. Also after repair works, and especially boiler lining, the starting of the boiler—due to the necessity of slow drying the lining—is prolonged up to several days and requires constant carrying away of the steam produced during that period to the exhaust. High-pressure steam carried away from the starting duct directly to the atmosphere, while expanding abruptly produces noise of a very high level within the limits of 140–160 dB.

At such high noise levels the presently applied protective equipment becomes inefficacious and particular organs of the body intensivly stimulated for vibrations are mechanically damaged. There are known absorption suppressors, resonance suppressors or appropriately selected sets of said suppressors. There are also known chamber noise suppressor of expanding gases and exhaust steam from steam boilers. Expanded gases pass successively through particular chambers of the suppressor, reducing the noise level.

A drawback of the mentioned suppressors is their limited application on account of the high pressure of exhaust steam, as well as their small ability of noise suppression and a disability to eliminate sounds of a high frequency.

Out of the known devices for noise suppression, the most similar to the subject of the application include a noise suppressor of expanding gases, and especially of exhaust steam from steam boilers, protected by the Polish Pat. No. 67 523. The said suppressor comprises a cylindrical outer guide, inside of which an initial-choking cone is situated, which is lagged with a sound insulation and which comprises perforated expanding partitions provided from the wider part of the perforated area with an inital expanding cylinder to which a perforated end of the expanding cylinder is attached, said end being terminated with a perforated cone of final choking. A drawback of the above specified suppressor is a low capacity of noise suppression being about 20% (about 25 dB), as well as a relatively complicated design thereof.

The object of the present invention is to achieve a high degree of noise suppression and a possibility of its application in all high-pressure boilers and steam plants in nuclear power plants, irrespective of their pressure and the rate of flow of steam.

The boiler noise suppressor according to the invention is characterized by that it has at least one truss mounted on the cover of an inlet flange by means of brackets at a distance of 50–500 mm from the cover and of a clearance of from 5 to 10 mm, a perforated expansion nozzle, a pipe system made of a several hundreds of pipes, a perforated outlet nozzle of the included of the cone of 0°–15°, at least one truss of a clearance of 5–30 mm mounted on the collar of the outlet nozzle, preferably inside the nozzle. The ratio of the diameter of the outer cylinder to the diameter of the inlet flange in the cover is from 3 to 5, preferably 4. The ratio of the length of the perforated outlet nozzle to the diameter of the outer cylinder is at least 1, and the ratio of the length of the perforated expansion nozzle to the diameter of the inlet flange is at least 12.

The boiler noise suppressor can be connected directly with the exhaust of the blow-out steam of a single industrial-power boiler or in a parallel connection, forming batteries of suppressors, at a connection with exhausts of blow-out steam from several boilers.

The pipe system of the noise suppressor can be additionally cooled in a parallel current or counter-current manner by air, water or other cooling medium with a possibility of utilizing thermal energy.

The subject of the invention is presented in the attached drawings, in which

EXAMPLE 1

Figure 1:
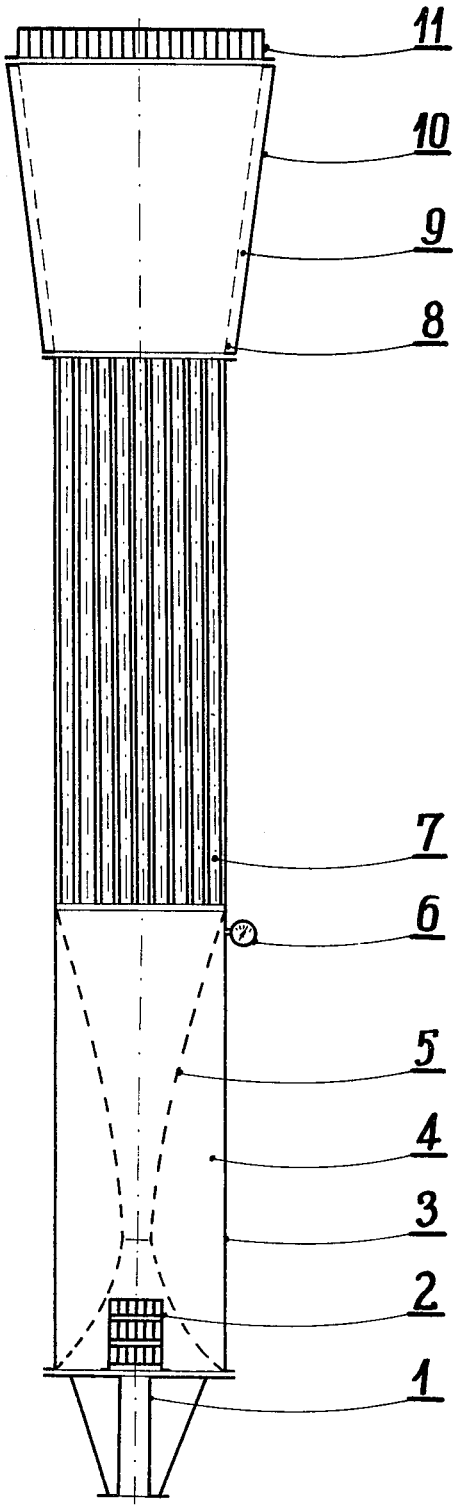
FIG. 1 shows the longitudinal section of the suppressor.
Figure 2:
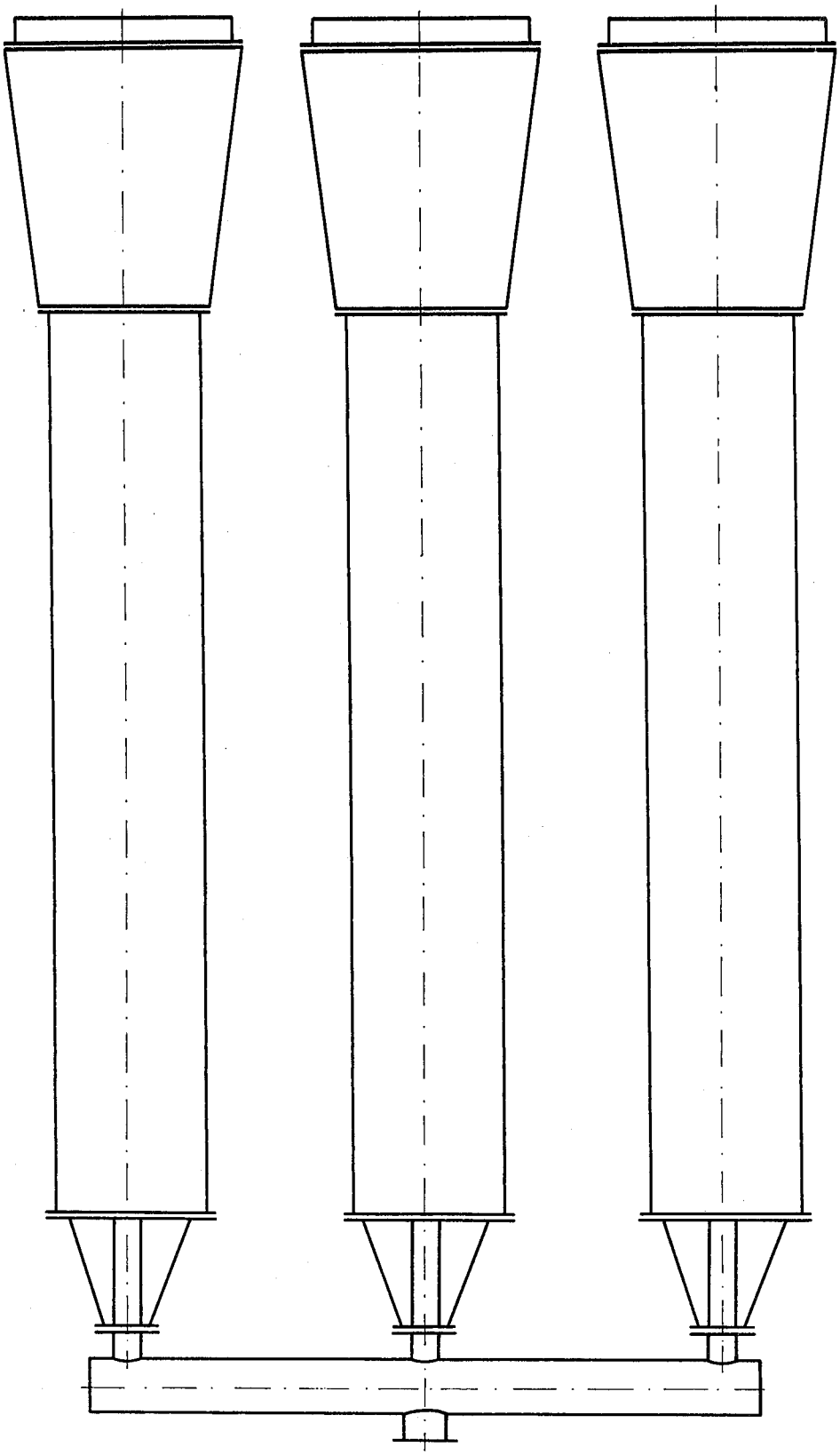
FIG. 2 and FIG. 3 show methods of a single- and a battery-connection of suppressors.
Figure 3:
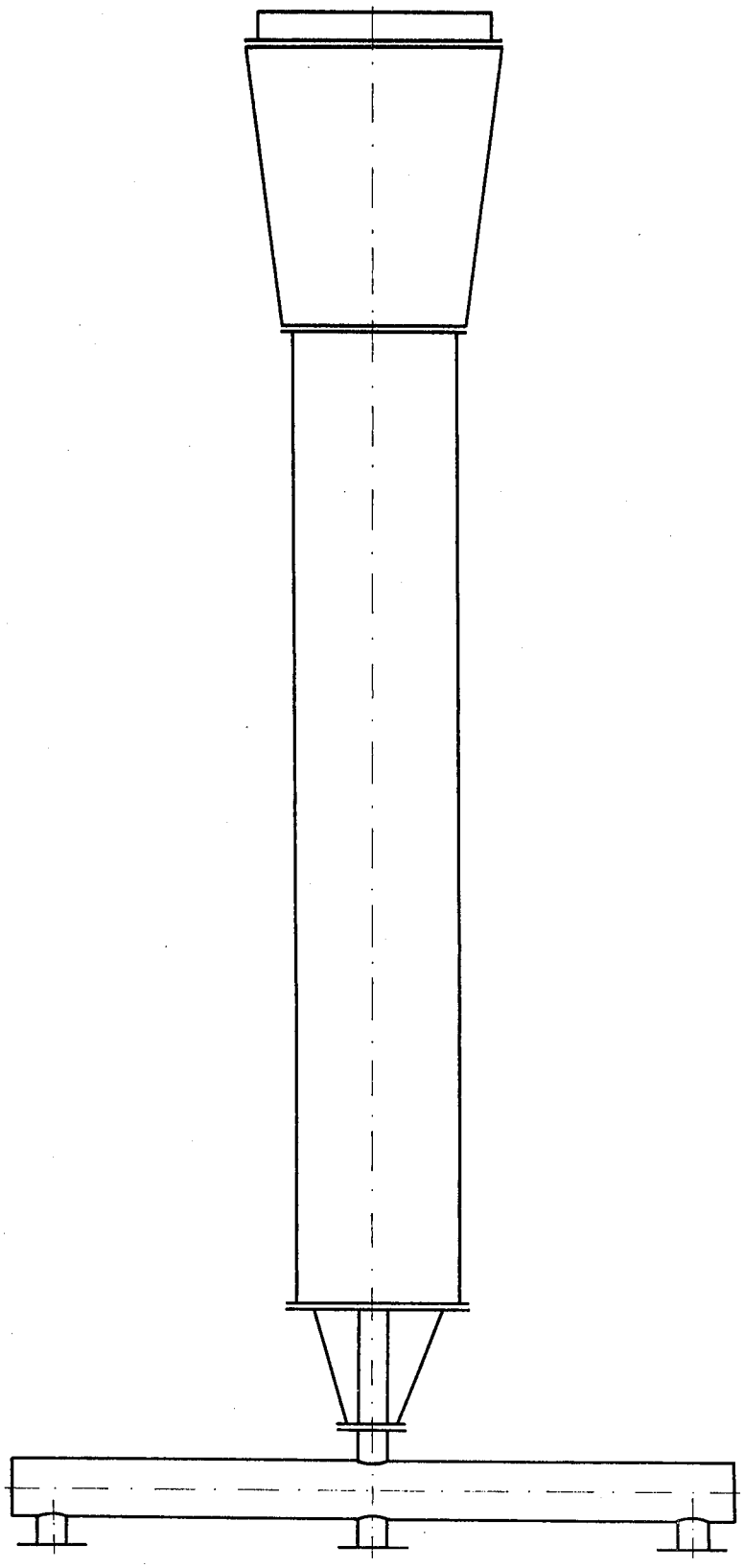

A boiler noise suppressor consists of a cover with an inlet flange 1, to which there are attached by means of brackets three trusses 2 situated centrically in the inlet part of a perforated expansion nozzle 5 forming together with an outer cylinder 3 a chamber of a variable section, filled up with a sound deadener 4. The outlet part of the perforated nozzle 5, in which a manometer 6 is mounted, is connected with a pipe input 7 made of pipes of outer diameters of 10 mm and of a wall thickness of 2.5 mm, to which a perforated outlet nozzle 8 is attached, which is lagged with a sound insulation 9 with an outer cone 10 put on, to the base of which through the collar of the expansion nozzle 8 a truss 11 of the clearance of 13×13 mm is attached.

The suppressor according to the invention operates in the following manner: high-pressure steam from the exhaust duct, supplied by the flange 1, passes successively through three trusses 2 made of steel sheet of the clearance of 13×13 mm situated in-series in the stream of steam. The chamber of a variable section formed between the perforated expansion nozzle 5 and the outer cylinder 3 is filled with sound deadeners 4. Steam expanded in the nozzle 5 passes then through a pipe system 7 consisting of 390 pipes of outer diameters of 10 mm and a thickness of 2.5 mm, on which it is divided into the same amount of single streams, which causes considerable scattering and suppression of acoustic energy. As it has been shown by research, single streams of steam and sound waves accompanying them, flowing into the common perforated outlet nozzle 8, are subject to further intensive suppression. The truss 11 of a clearance of 13×13 mm, mounted directly on the collar of the outlet nozzle 8, suppresses additionally the sound waves.

EXAMPLE 2

Figure 4:
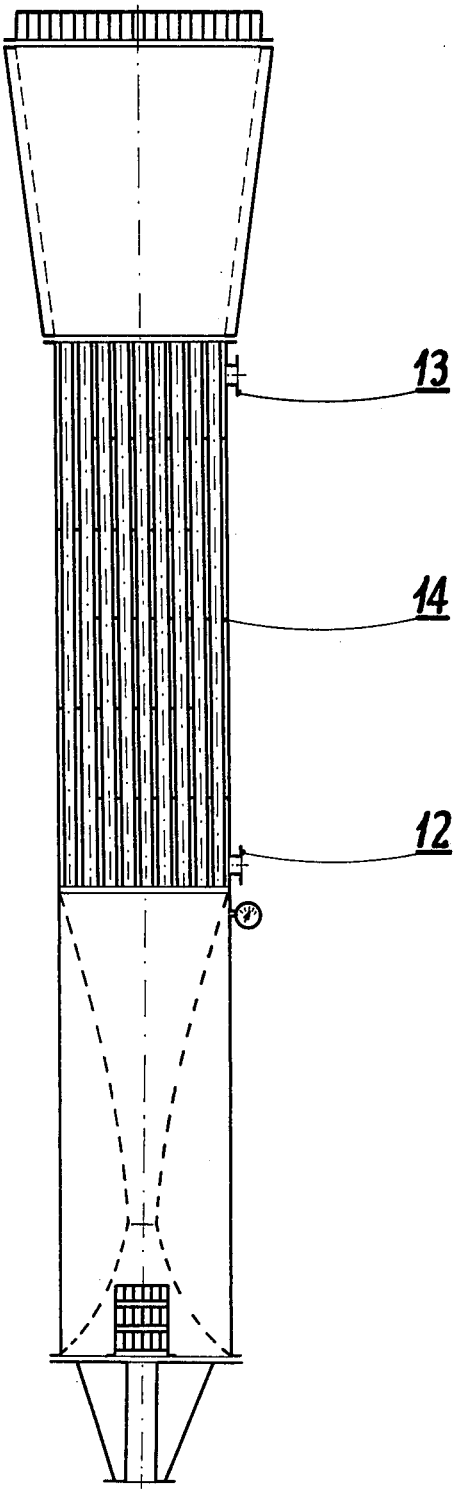
FIG. 4 shows the boiler noise suppressor with an application of a cooling medium.

FIG. 4 shows an embodiment of the boiler noise suppressor with an application of water cooling. Water supplied by a flange 12 passes successively between partitions 14, collecting a considerable amount of heat contained in steam and heating it at the same time to a temperature of about 100° C., and by the flange 13 is drained off outside. Both the application of a parallel current water circulation and of a counter-current water circulation additionally lowers the noise level of exhaust steam within the limits of 7–10 dB. Besides, heated water, depending on the existing possibilities and requirements, can be utilized for social or technological purposes.

We claim:

1. A noise suppressor for exhaust steam from high-pressure industrial-power boilers comprising a cylinder with sound deadener packing and with a truss attached to the cover of an inlet flange by means of brackets spaced from the cover and with a clearance, a perforated expansion nozzle, a pipe system of several hundreds of pipes, a perforated outlet nozzle of an included angle of the cone, at least one truss with a clearance mounted on a collar of an inlet nozzle and preferably inside the nozzle and wherein the ratio of the diameter of an outer cylinder to the diameter of the inlet flange in the cover is from 3 to 5, the ratio of the length of a perforated outlet nozzle to the diameter or said outer cylinder is at least 1, with the ratio of the length of the perforated expansion nozzle to the diameter of the inlet flange being at least 12.

2. Noise suppressor as in claim 1, wherein it is connected directly with the steam exhaust blow-out nozzle of a single industrial-power boiler or in a parallel connection forms batteries of suppressors by the connection with exhaust of blow-out steam from several boilers.

3. Noise suppressor as in claim 1, wherein it is connected directly with a multiplicity of steam exhaust blow-out nozzles.

4. Noise suppressor as in claim 3, wherein a battery thereof is connected to the steam exhaust blow-out nozzles.

5. Noise suppressor as in claim 1, wherein there are means provided for cooling the pipe system and additionally alternating noise by a parallel or counter-current fluid flow.

* * * * *